US008079830B2

(12) United States Patent
Süss et al.

(10) Patent No.: US 8,079,830 B2
(45) Date of Patent: Dec. 20, 2011

(54) REFRIGERANT COMPRESSOR

(75) Inventors: Jürgen Süss, Soenderborg (DK); Christian Jepsen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 395 days.

(21) Appl. No.: 12/471,698

(22) Filed: May 26, 2009

(65) Prior Publication Data

US 2010/0092316 A1 Apr. 15, 2010

(30) Foreign Application Priority Data

May 27, 2008 (DE) ..... 10 2008 025 320

(51) Int. Cl.
*F04B 39/02* (2006.01)
*F04B 27/04* (2006.01)

(52) U.S. Cl. ..... 417/372; 417/273; 418/90

(58) Field of Classification Search ..... 417/372, 417/273, 415, 419, 902; 92/148; 418/90
See application file for complete search history.

(56) References Cited

U.S. PATENT DOCUMENTS

| | | | |
|---|---|---|---|
| 3,388,855 | A | 6/1968 | Ayling et al. |
| 3,804,202 | A | 4/1974 | Funke |
| 3,926,281 | A | 12/1975 | Hannibal |
| 4,111,612 | A | 9/1978 | Paczuski |
| 4,421,453 | A | 12/1983 | Hoff et al. |
| 4,432,693 | A | 2/1984 | Hackbart |
| 4,470,772 | A | 9/1984 | Gannaway |
| 4,932,188 | A | 6/1990 | Krasuski |
| 5,176,506 | A | 1/1993 | Siebel |
| 5,707,220 | A | 1/1998 | Krueger et al. |
| 5,762,164 | A | 6/1998 | Krueger et al. |
| 5,884,727 | A | 3/1999 | Ryu |
| 5,980,222 | A | 11/1999 | Fry |
| 7,225,724 | B2 | 6/2007 | Lee |

FOREIGN PATENT DOCUMENTS

| | | | |
|---|---|---|---|
| DE | 6901980 | U | 10/1969 |
| EP | 0341408 | A2 | 11/1989 |
| EP | 0352693 | A1 | 1/1990 |
| EP | 0728946 | A1 | 8/1996 |
| GB | 1 122 348 | | 8/1968 |
| GB | 1122348 | A | 8/1968 |
| WO | 93/22557 | A1 | 11/1993 |
| WO | 00/01949 | A1 | 1/2000 |

*Primary Examiner* — Joseph L Williams

(74) *Attorney, Agent, or Firm* — McCormick, Paulding & Huber LLP

(57) ABSTRACT

The invention concerns a refrigerant compressor (1), particularly a semi-hermetic refrigerant compressor, with a housing (2), having in its bottom part (3) an oil sump (4), a compressor block (5) having at least one cylinder (6), in which a piston (7) is arranged, a crankshaft (11), which is supported in the compressor block (5) and in driving connection with the piston (7), and an oil pump arrangement (27), which is at least partly submerged in the oil sump. Also with varying speeds, good oil lubrication must be ensured. For this purpose, the crankshaft (11) has at its lower end a diameter extension (19), through which an oil channel (35) extends eccentrically to the crankshaft axis (36), said channel (35) connecting the oil pump arrangement (27) to a closed oil pressure chamber (21) between the crankshaft (11) and the compressor block (5), said chamber (21) being connected to the inside (37) of the housing (2) via a vent path (40, 41).

10 Claims, 3 Drawing Sheets

REFRIGERANT COMPRESSOR

CROSS REFERENCE TO RELATED APPLICATION

Applicant hereby claims foreign priority benefits under U.S.C. §119 from German Patent Application No. 10 2008 025 320.0 filed on May 27, 2008, the contents of which are incorporated by reference herein.

FIELD OF THE INVENTION

The invention concerns a refrigerant compressor, particularly a semi-hermetic refrigerant compressor with a housing, having in its bottom part an oil sump, a compressor block having at least one cylinder, in which a piston is arranged, a crankshaft, which is supported in the compressor block and in driving connection with the piston, and an oil pump arrangement, which is at least partly submerged in the oil sump.

BACKGROUND OF THE INVENTION

Such a refrigerant compressor is, for example, known from GB 1,122,348. This refrigerant compressor has in one embodiment three cylinders arranged in a star-shape. The pistons arranged in the cylinders are driven to a reciprocating movement by the crankshaft via a common crank pin. An oil pump arrangement is formed by an inclined pipe, whose end is submerged in the oil sump.

Such a refrigerant compressor serves the purpose of compressing refrigerant that is available in a gaseous form. This will cause a substantial load in the bearings, which connect mutually moving parts to one another. This is particularly the case, if refrigerants are used, which require a higher pressure, for example environmentally friendly refrigerants, such as $CO_2$.

Therefore, practically all refrigerant compressors use a lubrication, in which oil from the oil sump is supplied to certain places in order to reduce friction between mutually moving parts and thus also to reduce the wear.

For an energy saving mode of operation of a refrigerant compressor, it may be necessary to drive the refrigerant compressor with variable speed. In this case, it may be difficult always to ensure the oil supply. For example in connection with low speeds and the use of a centrifugal pump, only low pressures occur, with which the lubricant supply to the corresponding bearing points cannot always be ensured. With high speeds, however, the oil pressures are high, so that excess oil will be sprayed inside the housing. This involves the risk that oil will be mixed with the refrigerant, which is also supplied via the inside of the housing.

Another possibility is to build up a pressure difference between the oil sump and the bearing points, for example by means of a displacement pump. This, however, also involves the risk of generating a large oil flow, which will cause a relatively large leakage of the oil into the refrigerant flow. A narrowing of the channels carrying oil, to reduce the oil flow, can cause other problems, for example choking channels and relatively low flow rates of the oil at low speeds.

SUMMARY OF THE INVENTION

The invention is based on the task of providing oil lubrication, also at varying speeds.

With a refrigerant compressor as mentioned in the introduction, this task is solved in that at its lower end the crankshaft has a diameter extension, through which an oil channel extends eccentrically to the crankshaft axis, said channel connecting the oil pump arrangement to a closed oil pressure chamber between the crankshaft and the compressor block, said chamber being connected to the inside of the housing via a vent path.

The oil channel arranged eccentrically to the crankshaft axis causes that a relatively large oil amount is available, also at low speeds of the crankshaft. This oil amount is a result of the fact that the oil channel has a relatively large distance to the crankshaft axis, so that also with low speeds of the crankshaft a sufficient centrifugal force can act upon the oil and transport a correspondingly large oil amount through the oil channel. On the other hand, in spite of the large oil amount transported, there is practically no risk that oil will reach the refrigerant circuit in an undesired manner, because the oil pressure chamber is closed. The oil can reach neighbouring bearing points from the oil pressure chamber. For this purpose, the oil pressure ruling in the oil pressure chamber is used, said pressure being generated by the oil pump arrangement. The bearing points then form a very efficient throttle for the oil, so that only little oil, if any, for example in the form of drops, will be pressed out of the bearing points. With such small oil amounts, however, the risk that the lubrication oil will mix with the refrigerant is relatively small. On the other hand, the vent path ensures that at operation start of the compressor the oil pressure chamber can be vented relatively quickly, so that the oil can relatively quickly fill the oil pressure chamber. Thus, a sufficient lubrication of the bearing points to be lubricated is almost always ensured.

Preferably, the vent path has a central, axial gas channel in the crankshaft, said channel being connected to the oil pressure chamber via a radial channel. When the crankshaft rotates, the oil in the oil pressure chamber can not get through the radial channel into the gas channel against the centrifugal force. Thus, it remains in the oil pressure chamber, where it can act upon the connected bearing points with the required pressure. Refrigerant gas, however, that was available in the oil pressure chamber from operation begin, or that degases from the oil during operation, is displaced into the axial gas channel by means of the radial channel. The centrifugal force will of course also act upon the refrigerant gas, when the crankshaft rotates. However, the refrigerant has a substantially lower specific mass as the oil that is used for lubrication, so that there is no problem in displacing the refrigerant through the radial channel into the central channel. This is a simple way of ensuring that gas is displaced from the areas, in which only oil is wanted, however, at the same time that an uncontrolled spraying of oil inside the housing is prevented. Further, this embodiment involves the additional advantage of an energy-saving operation. When the oil pressure chamber is filled with oil, and the oil has the required pressure, the oil pump arrangement merely has to request the amount of oil that is "consumed" by the bearing points. As the energy consumption of the oil pump arrangement also depends on the amount of oil to be supplied, the energy consumption is kept low, when the supplied amount of oil is small.

Alternatively or additionally, it may be provided that the vent path extends through a bearing arrangement at the upper end of the crankshaft. In this case, the bearing arrangement provides a sufficient flow resistance for the oil, in order to maintain the pressure in the oil pressure chamber. On the other hand, the bearing arrangement causes only a small flow resistance for the refrigerant gas, so that the gas can relatively quickly escape from the oil pressure chamber, no matter if gas is concerned that is available in the oil pressure chamber at operation begin, or if gas is concerned that degases from the oil during operation.

It is preferred that the vent path performs a directional change inside the bearing arrangement. A directional change causes an additional flow resistance for the oil, but practically no additional resistance increase for the refrigerant gas. This is an easy way of ensuring that the oil pressure in the otherwise closed oil pressure chamber is maintained at the desired value.

Preferably, the vent path has a first groove or cutting in a radial bearing and/or a second groove or cutting in an axial bearing. In this connection, it is preferred that in the area of its upper end the crankshaft is supported on the compressor block via an axial bearing and a radial bearing. If a groove is provided in both the radial bearing and the axial bearing, refrigerant gas can quickly escape through this groove. Instead of a groove a cutting at the crankshaft can simply be used to generate a small flattening, which then forms at least a part of the vent path. With a corresponding dimensioning, the flow resistance for the oil will, however, be sufficient to minimise the pressure loss from the oil pressure chamber.

Preferably, the oil channel is connected to a radial bearing in the area of the lower end of the crankshaft. Thus, the crankshaft can be supported twice in the compressor block at an axial distance. The oil channel can also ensure the lubrication of the lower radial bearing without problems. For this purpose a vent possibility is not required.

Preferably, the crankshaft has, in the area of its diameter extension, a crank pin whose circumference is connected to the oil channel via at least one radial channel. Also the lubrication of a contact area between the crank pin and a crank eye of a connecting rod can thus be ensured via the oil channel. In the oil channel the pressure is the same as in the oil pressure chamber, so that the also lubrication of the points supplied directly from the oil channel takes place under a sufficient pressure.

It is preferred that the crank pin is located radially outside an opening of the gas channel at the lower end of the crankshaft. Thus, the crank pin does not hinder the escape of gas from the gas channel. Further, now the crank pin is located so far radially outwards that the oil channel passing through the crank pin has a sufficient radial distance to the crankshaft axis. The larger this distance is, the larger is the centrifugal force acting upon the oil and the larger can the pressures generated in the oil pressure chamber be made.

Preferably, the oil pump arrangement has a first delivery element, which is submerged in the oil sump and has a smaller diameter at the lower end than at the upper end and is provided with a cover element at the upper end, and a second delivery element with a radial delivery channel connecting an opening in the cover element to the oil channel starting radially further outwards. With such an embodiment, the first delivery element, in the form of a "classical" oil pump, can provide an initial pressure, that is, the first delivery element delivers oil to the radial delivery channel in the second delivery element. This radial delivery channel then, in a manner of speaking, has an amplification function, as it guides the oil over a relatively large radial length, namely from the opening in the cover element of the first delivery element to the oil channel. This radial distance is sufficient to accelerate the oil by means of the centrifugal force in such a manner that the necessary oil pressure is available in the oil pressure chamber. Thus, the two-step oil pump arrangement makes it possible to provide relatively high oil pressures with relatively little effort. As, however, the oil pressure chamber is closed, there is no risk that oil will spread to the environment in an uncontrolled manner.

Preferably, the second delivery element has the form of a plate, the delivery channel being formed by a slot, covered from below by the cover element and from above by the crankshaft. More precisely, the slot is covered from above by the crank pin of the crankshaft. This gives a relatively simple design.

The oil pump arrangement is made up of three elements. Apart from the first delivery element, merely two plates are required, namely the cover element and the second delivery element, which can relatively easily be assembled and connected to each other, for example by means of screws or bolts. Together with this assembly, also a connection of the cover element and the second delivery element to the crank pin of the crankshaft can be made.

In the following, the invention is described on the basis of a preferred embodiment in connection with the drawings, showing:

DETAILED DESCRIPTION OF THE PREFERRED EMBODIMENTS

Figure 1:
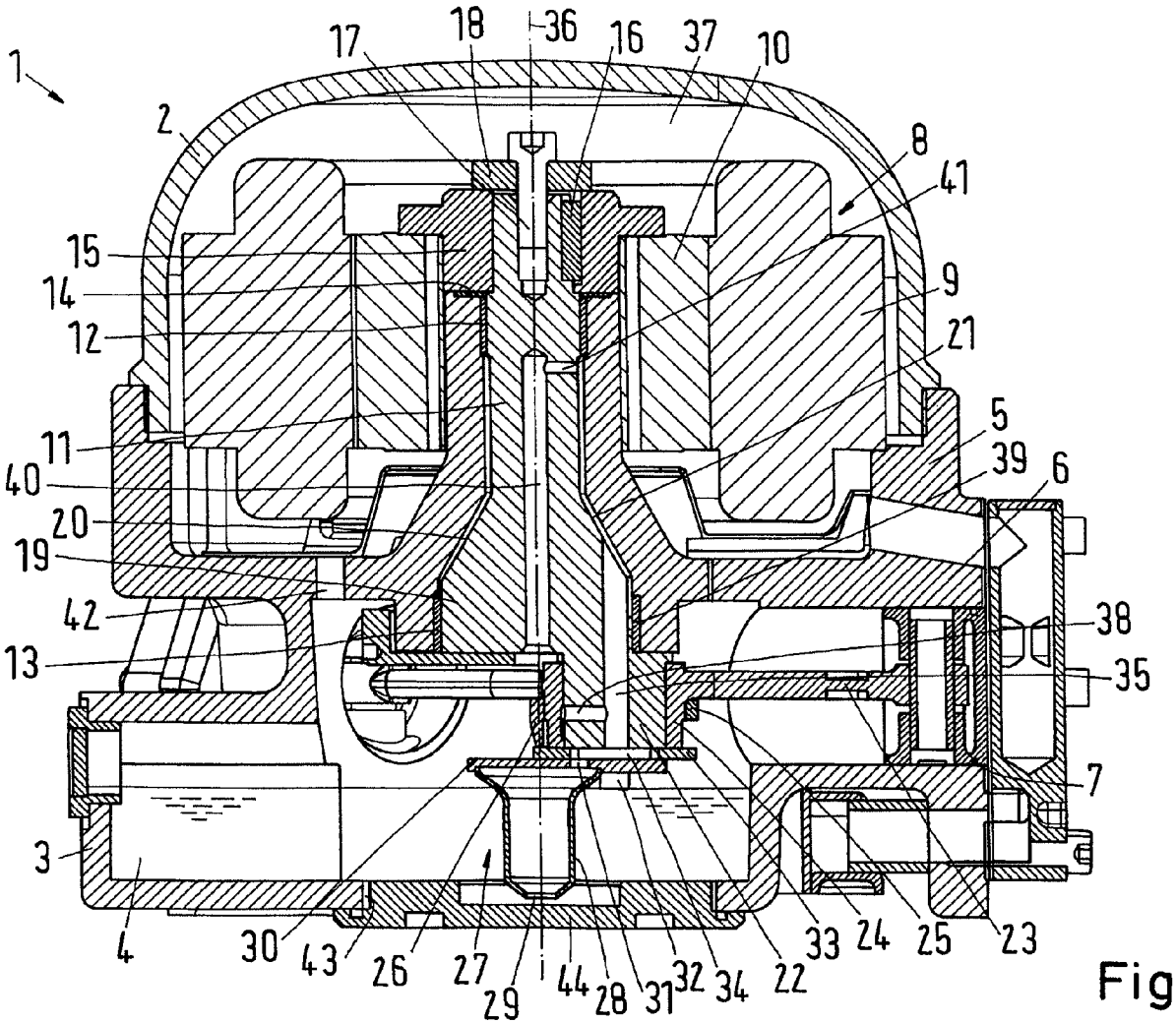
FIG. 1 is a cross-section through a semi-hermetic refrigerant compressor.

FIG. 1 shows a semi-hermetic refrigerant compressor 1 with a housing 2, in whose bottom part 3 an oil sump 4 is located. The compressor 1 comprises a compressor block 5, in which several, in the present case three, cylinders 6 are arranged symmetrically and in a star-shape, that is, in the circumferential direction the central axes of the cylinders 6 have a distance of 120°. A piston 7 is arranged in each cylinder 6.

It is shown that the bottom part 3 of the housing 2 is made in one piece with the compressor block 5. This is advantageous, but not absolutely necessary. A subdivision can be made between the bottom part 3 and the compressor block 5. The compressor block 5 and the bottom part 3 can be made as castings.

Further, the compressor 1 has an electric motor 8, whose stator 9 is connected to the compressor block 5 in a manner not shown in detail. Further, the motor 8 has a rotor 10. The motor can be a permanent-magnet driven synchronous motor, whose rotor can comprise permanent magnets in a manner not shown in detail.

A crankshaft 11 is rotatably supported in the compressor block 5. In this connection, the support takes place via a first radial bearing 12 at the upper end of the crankshaft, a second radial bearing 13 at the lower end of the crankshaft 11 and an axial bearing 14, also located at the upper end of the crankshaft 11.

A bearing element 15 rests on the axial bearing 14, said bearing element 15 being rotatably connected to the crankshaft 11 via a spring 16. By means of a screw 17 the crankshaft 11 is held against a carrier plate 18, which rests on the bearing element 15 in the gravity direction. Thus, the crankshaft 11 is positioned in the axial direction in relation to the compressor block 5.

At its lower end the crankshaft 11 has a diameter extension 19. The diameter extension 19 extends via a conical area 20, which is located between the two radial bearings 12, 13, into the remaining section of the crankshaft 11. Between the two radial bearings 12, 13, the compressor block 5 surrounds the crankshaft 11 at a small distance, so that here an oil pressure chamber 21 is formed.

At its lower end the crankshaft 11 has a crank pin 22. Via a connecting rod 23, each piston 7 is connected to the crank pin 22. Each crank pin 23 has a bearing pad 24, which rests on the circumferential surface of the crank pin 22. The bearing pads 24 are held on the crank pin 22 by means of a ring 25. In this connection, the connecting rod 23 is displaced in relation to the axial centre of the crank pin 22 in the direction of the radial bearing 13, also called main bearing. The ring 25 is located on the side of the connecting rod 23 facing away from the main bearing 13. The ring 25 is provided with several feet 26, which extend as far downwards in the axial direction as the bearing pads 24.

An oil pump arrangement 27 is fixed at the lower end of the crank pin 22. The oil pump arrangement 27 comprises a first delivery element 28 that is submerged in the oil sump 4 and has an opening 29 at the lower end, through which oil can enter the inside of the first delivery element 28. As can be seen from the drawing, the first delivery element has at its lower end a smaller diameter than at its upper end. When the first delivery element 28 rotates, the oil inside the first delivery element will accordingly be transported upwards by the centrifugal force.

On the upper side, the first delivery element 28 is covered by a cover 30 in the form of a plate. In an area under the crank pin, the cover 30 has an opening 31. Otherwise, the cover 30 extends so far over the front side of the crank pin 22 that the first delivery element 28, which is, for example, assembled with the cover 30 by means of jamming, welding or gluing, can be fixed at the crank pin 22 by means of the cover 30. For this purpose, the cover element 30 is connected to the crank pin 22 by means of screws 32, which are screwed into the front side of the crank pin 22.

Between the cover element 30 and the crank pin 22 a second delivery element 33 is arranged, which comprises a radially extending slot 34.

An oil delivery channel 35 passes through the diameter extension 19 eccentrically to the crankshaft axis 36. In other words, the oil delivery channel 35 has, in the radial direction, a relatively large distance to the crankshaft axis 36. The slot 34 in the second delivery element 33 extends from the opening 31 in the cover element 30 to the oil delivery channel 35. Oil getting into the slot 34 from the first delivery element 28 and the opening 31 is therefore pressed into the oil delivery channel 35 that is connected to the oil pressure chamber 21 at a relatively high pressure. The oil pressure of course also depends on the speed of the crankshaft 11.

The oil pressure chamber 21 is closed, apart from a vent path, through which, however, only relatively little oil, if any at all, can escape. Accordingly, a relatively high oil pressure can be built up in the oil channel 35 and also in the oil pressure chamber 21, said pressure ensuring that the radial bearings 12, 13 and the axial bearing 14 are sufficiently lubricated. An escape of oil to the environment is practically non-existing. Accordingly, the risk is small that the escaping oil mixes with refrigerant gas that flows in the inner chamber 37 of the housing 2.

From the oil delivery channel 35 a first radial channel 38 branches off, which ends in the circumferential surface of the crank pin 22 and supplies this circumferential surface of the crank pin 22 with oil under a certain pressure, so that the contact points between the crank pin 22 and the bearing pads 24 are lubricated. A second radial channel 39 ends in the area of the main bearing 13, so that the main bearing 13 is not only lubricated by oil from the oil pressure chamber 21, but also directly from the oil delivery channel 35. Alternatively, other cuttings can be made to generate oil channels.

In its axial centre, the crankshaft 11 has a gas channel 40, which opens at the lower front side of the crankshaft 11 in the inner chamber 37 of the housing 2. The crank pin is located so that it leaves the opening into the gas channel 40 completely free. The gas channel 40 is connected to the oil pressure chamber 21 via a radial bore 41.

In a manner not shown in detail, the first radial bearing 12 and the axial bearing 14 are provided with a small groove, through which the oil from the oil pressure chamber 21 can flow. The cross-section of these grooves is, however, relatively small, so that these grooves provide a substantial resistance against the oil. These grooves can be provided additionally or alternatively to the gas channel 40. Additionally or alternatively to the grooves, cuttings at the crankshaft can also be used to form one or more flattenings, which are then used as vent channel.

During operation start the oil channel 35 and the oil pressure chamber 21 usually do not contain oil, but gas, for example refrigerant gas. Also during operation, it may happen that refrigerant gas degases from the oil, so that gas bubbles occur in the oil, which could have a negative influence on the lubrication properties of the oil. The oil displaces these gas bubbles into the radial bore 41, from where they can flow off into the inner chamber 37 via the gas channel 40. Oil, however, cannot flow off through the radial bore 41, as the centrifugal force acting upon the oil during a rotation of the crankshaft 11 cannot press the oil inwards. Accordingly, the gas channel 40 and the radial bore 41 form a vent path, through which practically no oil can escape into the environment from the oil pressure chamber 21.

Also with the alternative embodiment of the vent path with the grooves in the first radial bearing 12 and in the axial bearing 14, practically no oil can escape in an uncontrolled manner from the oil pressure chamber 21 into the environment. Firstly, as mentioned, the grooves have a so small cross-section that they provide a substantial resistance against the oil. Secondly, the oil would have to perform a practically rectangular directional change, which would also contribute to an increase of the flow resistance. For refrigerant gas that gathers in the oil pressure chamber 21, however, this flow resistance is smaller, so that the refrigerant gas can easily escape through this kind of vent path. If oil should escape through this vent path, it will end inside the rotor 10, from where it can run to the upper side of the compressor block 5 and flow off into the oil sump 4 through oil openings 42.

The bottom part 3 of the housing 2 has a mounting opening 43, which is closed by a closing element 44. The closing element 44 is screwed into the bottom part 3. The size of the mounting opening 43 is so that the crankshaft 11 with diameter extension 19 and crank pin 22 can be inserted in the compressor block 5 from the bottom part 3. In this connection, the closing element 44 is screwed into the mounting opening 43.

Figure 2:
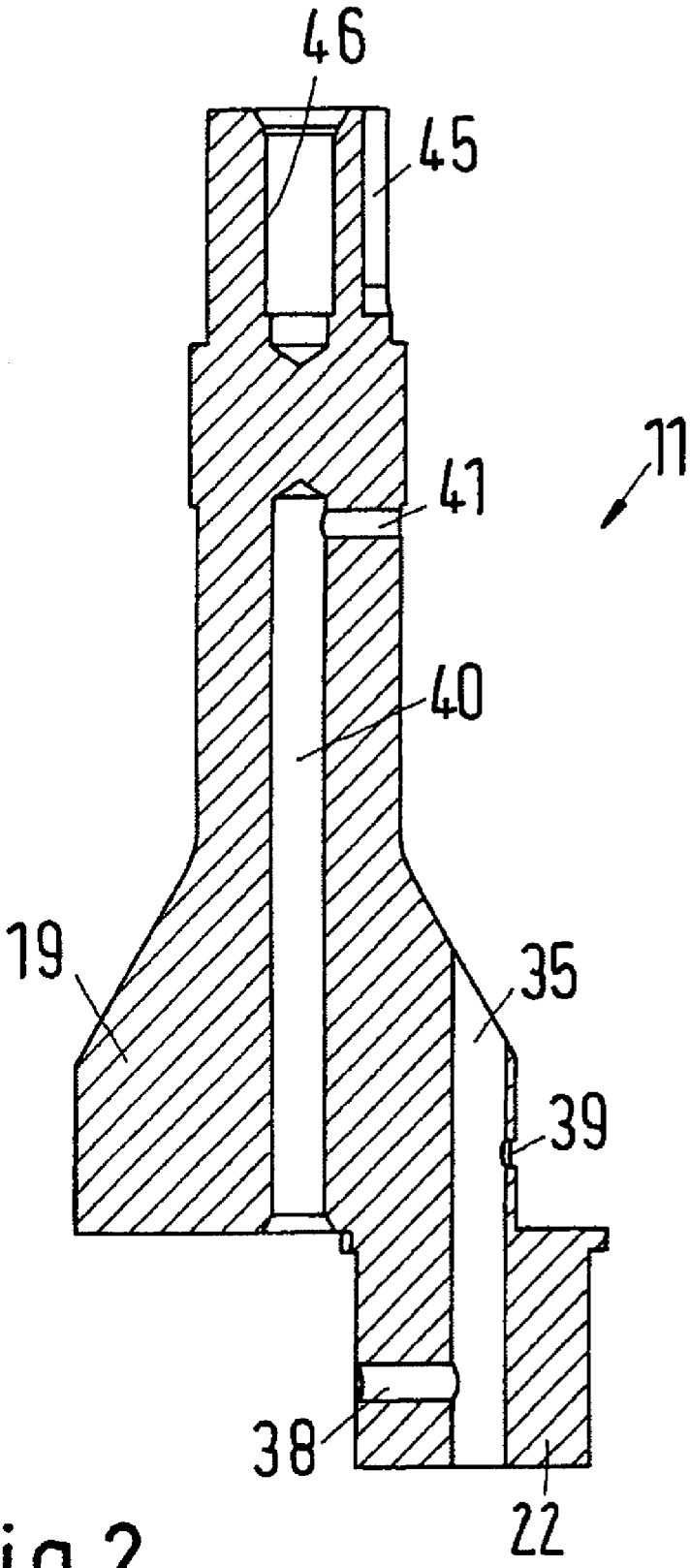
FIG. 2 is an enlarged view of the crankshaft.

FIG. 2 shows the crankshaft 11 alone. The upper end of the crankshaft 11 comprises a groove 45, into which a spring 16 can be inserted to provide an unrotatable connection between the crankshaft 11 and the bearing element 15 and the rotor 10. Further, an inner thread 46 can be seen, into which the screw 17 is screwed, which connects the crankshaft 11 to the carrier plate and thus, via the bearing element 15, to the rotor 10.

In the axial centre of the crankshaft 1 the gas channel 40 can be seen, which is led to the outside via the radial bore 41.

Approximately in parallel to the gas channel 40 the oil channel 35 extends, which ends via the first radial bore 38 in the circumferential surface of the crank pin 22 and via the second radial bore 39 in the circumferential surface of the diameter extension 19, which interacts with the second radial bearing 13.

Figure 3:
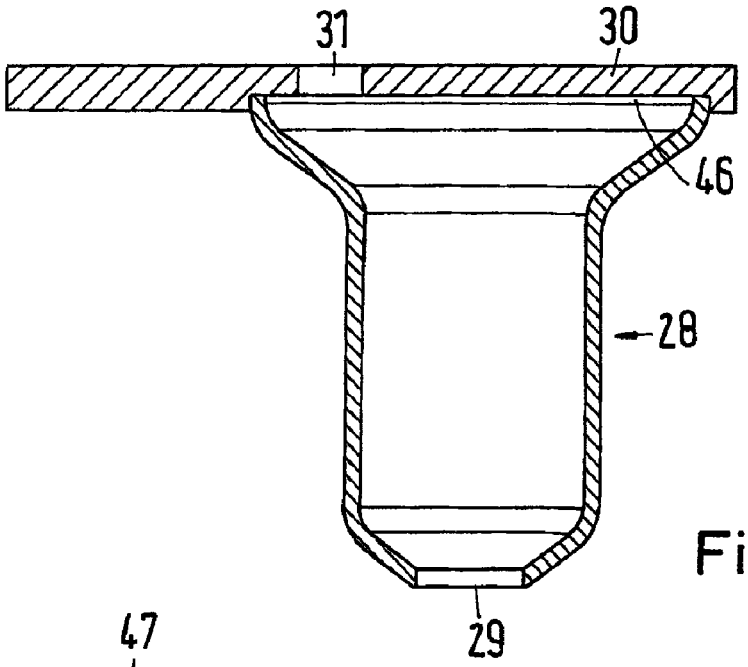
FIG. 3 is a sectional view of a first delivery element.

FIG. 3 shows the first delivery element 28 in an enlarged view. The same elements as in FIG. 1 are provided with the same reference numbers. It can be seen that the cover element 30 is mounted on the first delivery element 28. For this purpose, the bottom side of the cover element 30 has a circular recess 46, in which the first delivery element 28 is fixed. If required, also a welded, soldered or glued connection can be made here.

Figure 5:
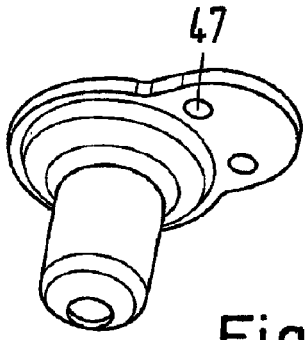
FIG. 5 is a perspective view of the first delivery element.
Figure 4:
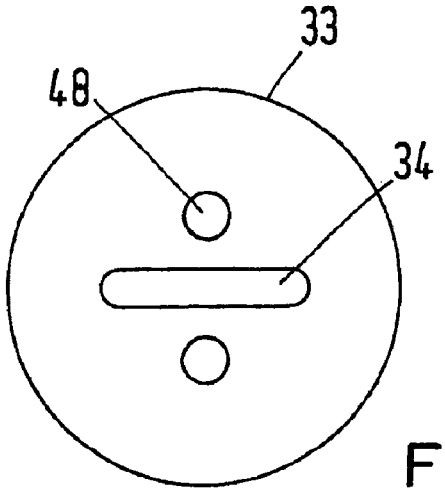
FIG. 4 is a top view of the second delivery element.

The cover element 30 comprises the opening 31, via which oil from the first delivery element 28 can reach the slot 34 at the second delivery element 33. Further, the cover element 30 (FIG. 5) comprises two screw holes 47, through which the screws 32 shown in FIG. 1 can be guided to connect the first delivery element 28 to the crank pin 22. Also the second delivery element 33 comprises corresponding screw holes 48, so that the screws 32 can be guided through the cover element 30 and the second delivery element 33.

Also with relatively low speeds a sufficient lubrication of the corresponding bearing points is ensured. Firstly, the oil merely has to overcome the height of the first delivery element 28. As soon as oil reaches the opening 31, the "booster" function of the second delivery element 32 becomes active, which does, due to the relatively long acceleration path, that is, the large radial distance between the opening 31 and the oil channel 35, exert a sufficient centrifugal force upon the oil, so that the oil can be supplied to the oil pressure chamber 21 with a sufficient pressure.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A refrigerant compressor, particularly a semi-hermetic refrigerant compressor with a housing, having in its bottom part an oil sump, a compressor block having at least one cylinder, in which a piston is arranged, a crankshaft, which is supported in the compressor block and in driving connection with the piston, and an oil pump arrangement, which is at least partly submerged in the oil sump, wherein at its lower end the crankshaft has a diameter extension, through which an oil channel extends eccentrically to the crankshaft axis, said channel connecting the oil pump arrangement to a closed oil pressure chamber between the crankshaft and the compressor block, said chamber being connected to the inside of the housing via a vent path.

2. The compressor according to claim 1, wherein the vent path has a central, axial gas channel in the crankshaft, said channel being connected to the oil pressure chamber via a radial channel.

3. The compressor according to claim 1, wherein the vent path extends through a bearing arrangement at the upper end of the crankshaft.

4. The compressor according to claim 3, wherein the vent path performs a directional change inside the bearing arrangement.

5. The compressor according to claim 4, wherein the vent path has a first groove or cutting in a radial bearing and/or a second groove or cutting in an axial bearing.

6. The compressor according to claim 1, wherein the oil channel is connected to a radial bearing in the area of the lower end of the crankshaft.

7. The compressor according to claim 1, wherein the crankshaft has, in the area of its diameter extension, a crank pin whose circumference is connected to the oil channel via at least one radial channel.

8. The compressor according to claim 7, wherein the crank pin is located radially outside an opening of the gas channel at the lower end of the crankshaft.

9. The compressor according to claim 1, wherein the oil pump arrangement has a first delivery element, which is submerged in the oil sump and has a smaller diameter at the lower end than at the upper end and is provided with a cover element at the upper end, and a second delivery element with a radial delivery channel connecting an opening in the cover element to the oil channel starting radially further outwards.

10. The compressor according to claim 9, wherein the second delivery element has the form of a plate, the delivery channel being formed by a slot, covered from below by the cover element and from above by the crankshaft.

* * * * *